United States Patent [19]

Baranski

[11] Patent Number: 4,636,142

[45] Date of Patent: Jan. 13, 1987

[54] ROTATING FAN APPARATUS

[75] Inventor: Bernard R. Baranski, Indianapolis, Ind.

[73] Assignee: Household Manufacturing, Inc., Prospect Heights, Ill.

[21] Appl. No.: 609,543

[22] Filed: May 11, 1984

[51] Int. Cl.[4] ..... F04D 29/38

[52] U.S. Cl. ..... 416/210 R; 416/222; 416/241 A

[58] Field of Search ..... 416/210 R, 229 R, 241 A, 416/244 R, 222, 204 R, 204 A

[56] References Cited

U.S. PATENT DOCUMENTS

| | | | |
|---|---|---|---|
| 2,033,345 | 3/1936 | Lee | 416/240 |
| 2,251,887 | 8/1941 | Larsh | 416/240 |
| 2,965,180 | 12/1960 | Killam | 416/210 R |
| 3,042,369 | 7/1962 | Welsh | 416/222 UX |
| 3,260,312 | 7/1966 | Elmer | 416/241 R |
| 3,622,249 | 11/1971 | Hayashi | 416/204 |
| 3,628,888 | 12/1971 | Wooden | 416/210 R |
| 3,751,181 | 8/1973 | Hayashi | 416/132 |
| 3,785,748 | 1/1974 | Gorman | 416/210 R X |
| 4,120,257 | 10/1978 | Matucheski | 416/210 R X |

FOREIGN PATENT DOCUMENTS

| | | | |
|---|---|---|---|
| 1428276 | 12/1963 | Fed. Rep. of Germany | 416/241 A |
| 212488 | 3/1924 | United Kingdom | 416/241 A |

*Primary Examiner*—Robert E. Garrett
*Assistant Examiner*—Joseph M. Pitko
*Attorney, Agent, or Firm*—Woodard, Weikart, Emhardt & Naughton

[57] ABSTRACT

A fan apparatus including a fan spider having a hub portion and a plurality of outwardly extending arms, a plurality of fan blade assemblies, each fan blade assembly having a molded plastic blade with an attachment insert partially embedded within, the exposed portion of each attachment insert being rigidly attached to a corresponding one of the arms of the spider.

26 Claims, 6 Drawing Figures

BEST AVAILABLE COPY

ROTATING FAN APPARATUS

BACKGROUND OF THE INVENTION

1. Field of the Invention

The present invention relates to a rotating fan, and more particularly to a rotating fan having lightweight plastic blades.

2. Description of the Prior Art

Various rotating fans have been proposed in the prior art for providing a flow of air, particularly for cooling vehicle engines. It has been of particular concern to provide a fan having lightweight blades to reduce the effects of centrifugal and vibrational forces. It is also desirable to provide a fan which may be constructed relatively inexpensively.

A typical fan of the prior art has a spider and several blades stamped from a single sheet of steel. The center of the spider is provided with a hub for attaching the spider to a shaft. Such a fan must be constructed from relatively thick sheet metal to provide a ridigity. One consequence of using thick metal is that a relatively large portion of the fan's mass is distributed at some distance from the axis of rotation, resulting in a large moment of inertia for each blade. This necessitates careful balancing of the fan to avoid vibration. Relatively large centrifugal forces also result from the heavy blades, increasing the stress on the metal at the root of the blades and making failure from metal fatigue more likely.

One way of providing a lightweight fan to avoid many of the above problems is described in U.S. Pat. No. 3,628,888, issued to Wooden on Dec. 21, 1971. Wooden discloses a lightweight, inexpensive blade assembly including a fan spider having integral arms. The blades are formed by overlying a smaller thin metal plate adjacent a larger thin metal plate and spot-welding them together at the perimeter of the smaller plate. An extended arm of the fan's spider is received between the plates, with rivets holding the laminated assembly together.

Another approach to providing a lightweight fan involves the use of molded plastic blades. Examples of such fans are described in U.S. Pat. Nos. 3,260,312, issued to Elmer on July 12, 1966; 3,622,249, issued to Hayashi et al. on Nov. 23, 1971; and 3,751,181, issued to Hayashi on Aug. 7, 1973.

Elmer describes a fan wherein the blades are formed of a plastic material molded integrally about a central metal hub. Embedded in each blade is a metal spring member anchored to the hub, which provides controlled twisting of the blade and consequent automatic adjustment of the pitch of the blades as their rotational speed varies.

Hayashi et al. describes a fan assembly having an integrally molded plastic hub and blades. The plastic hub is provided with metal bushings for receiving bolts which secure the fan assembly to the driving member of a fluid coupling.

Hayashi describes a fan assembly having a hub with integral arms extending outwardly therefrom. Plastic blades are integrally molded about the arms and the hub. The arms are provided with holes into which the plastic of the blades extends to provide a firm bond between the blades and the arms.

Various other fan constructions have been proposed in the prior art. In U.S. Pat. No. 2,251,887, issued to Larsh on Aug. 5, 1941, there is described a flexible fan unit utilizing paper fabric fiber or rubber blades secured over a metallic reinforcing core. A rubber coating received upon metallic blades is described in U.S. Pat. No. 2,033,345, issued to Lee on Mar. 10, 1936. It is also known in the propeller field to construct aircraft propeller blades with a cylindrical metal root to which composite graphite fiber blades are attached, with the metal root being attached to a metal hub.

SUMMARY OF THE INVENTION

Describing one aspect of the present invention, there is provided a fan including a fan spider having a hub and a plurality of outwardly extending arms and a fan blade assembly attached to each of the arms. Each fan blade assembly includes a molded plastic fan blade having an attachment insert partially embedded within. Means are provided for rigidily attaching the attachment insert of each fan blade assembly to a corresponding one of the arms of the fan spider.

It is an object of the present invention to provide a novel fan for providing a flow of air.

A further object of the present invention is to provide a fan having lightweight, yet strong blades.

Another object of the present invention is to provide a fan which is economical to construct.

It is a further object of the present invention to provide a fan apparatus which includes plastic fan blades which may be readily secured to a fan spider with reduced problems of stress or fatique due to the attachment.

DESCRIPTION OF THE PREFERRED EMBODIMENT

Figure 1:
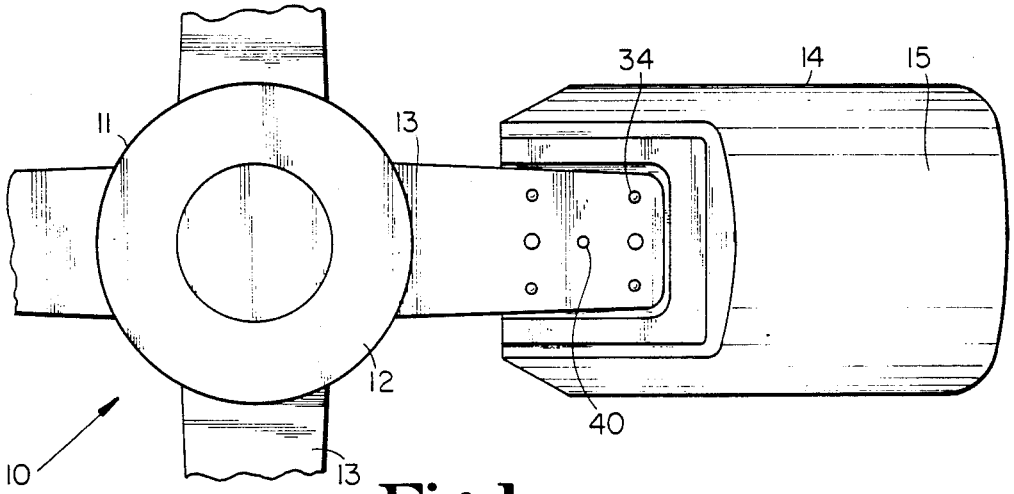
FIG. 1 is a front, elevational view of a fan apparatus constructed in accordance with the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to the drawings, there is shown a fan construced in accordance with the present invention. As will be described in detail, the fan preferably comprises several components which may be readily assembled. The fan apparatus 10 includes a fan spider 11 having a hub portion 12 and a plurality of arms 13 extending

BEST AVAILABLE COPY radially outwardly from hub portion 12. Attached to each of the arms 13 is a fan blade assembly 14 which includes a molded plastic fan blade 15 and attachment insert 16.

Several desirable advantages result from constructing a fan in accordance with the present invention. The advantage of using plastic blades to reduce weight is well known. Because of the limited strength of plastic, however, it is advantageous to employ a stronger material, such as steel or other metal, at the point of maximum stress where the blade attaches to the hub. The preferred embodiment of the present invention envisages a "hybrid" construction employing a steel or other metal spider with radial arms to which plastic blades are affixed. In order that the strength advantage of such a construction not be lost, it is advantageous that the arms be connected to the plastic blades in a manner which will not compress the plastic or otherwise introduce localized stress. The present invention contemplates encasing a portion of a steel or other metal attachment insert in the plastic fan blade during molding of the blade. The term encasing is used herein to denote that the plastic blade material completely surrounds or envelops a portion of the insert so as to thereby provide a securement of the insert with the plastic blade. The encasement provides for securement of the insert with the plastic blade without other fastening means, and the insert by virtue of the encasement is not readily separable from the plastic blade. The exposed portion of the attachment insert is then rigidly attached to the arm of the spider by means of rivets or bolts.

By employing a separate attachment insert which is made integral with the plastic fan blade rather than merely molding a fan blade onto each of the arms of the spider, it is possible to reduce the costs of the molding process. The mold need only be large enough to accommodate one blade and its attachment insert, rather than the entire fan. Additionally, such a construction allows a few standard molded blades to be combined with a variety of spiders, thus enabling the production of many different fans without requiring a separate mold for each.

Referring in particular to FIG. 1, fan spider 11 is provided with a hub portion 12 which may be of any conventional configuration for connecting the spider to a shaft, to a fluid coupling, or to other drive means. Extending outwardly from hub portion 12 generally radially is a plurality of arms 13, each arm having a planar surface end portion for engaging attachment insert 16.

Arm 13 is typically twisted about its radial axis such that the end portion lies at an angle with respect to the plane of rotation of the fan, the degree of twist determining the chord angle of the mounted fan blade assembly. Because the chord angle is determined wholly by the spider, fans having various chord angles may be assembled without changing the design of the fan blade assembly, resulting in a reduction of manufacturing and inventory costs.

Figure 2:
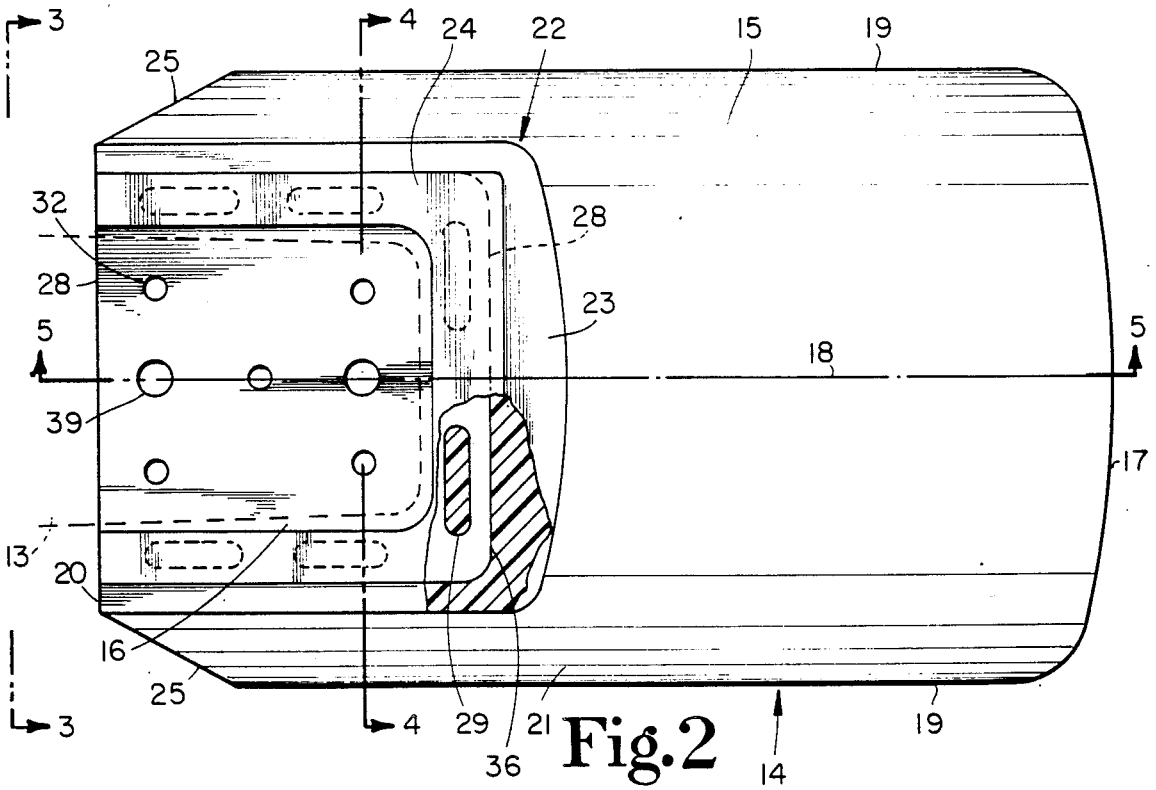
FIG. 2 is a top, plan view of a fan blade assembly useful in conjunction with the present invention.
Figure 3:
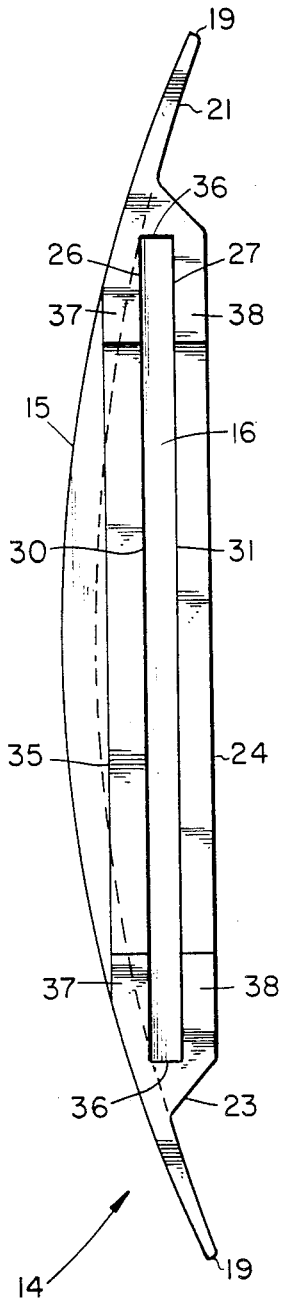
FIG. 3 is an end, elevational view of the fan blade assembly of FIG. 2.
Figure 4:
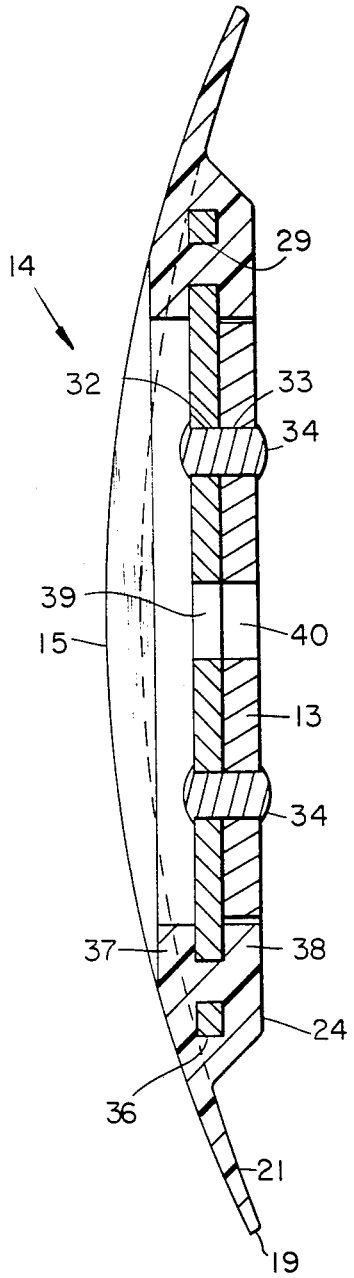
FIG. 4 is an end, cross-sectional view of the fan blade assembly of FIG. 2, taken along the line 4—4 and looking in the direction of the arrows.
Figure 5:
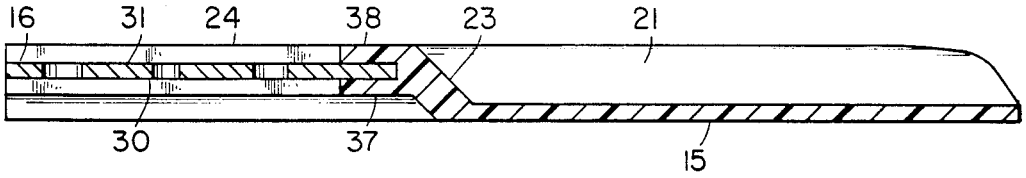
FIG. 5 is a side, cross-sectional view of the fan blade assembly of FIG. 2, taken along the line 5—5 and looking in the direction of the arrows.

Referring in particular to FIG. 2, a detailed view of one of the fan blade assemblies is shown. Although only one of the fan blade assemblies is illustrated, it is to be understood that all of the fan blade assemblies are substantially identical. Fan blade 15 is molded of a lightweight plastic material having strength, flexibility and molding properties which are suitable for a fan blade application. Such plastics are well known in the art, plastic fan blades having been employed extensively in recent years.

Fan blade 15 is a straight, elongated blade of constant width and constant camber, having a smoothly rounded blade tip 17. The camber is preferably chosen to provide maximum aerodynamic lift and efficiency for the particular application. In the preferred embodiment the blade is bilaterally symmetrical with respect to the long axis, which, along with the constant width and camber, reduces the expense of the molds employed in the fabrication of the blade. Although the resulting blade shape is not necessarily optimally efficient, this shape allows the fan to operate reasonably efficiently when the direction of rotation is reversed, thus providing for push-pull operation. The transverse cross-section thickness of fan blade 15 is varied, diminishing from the center 18 to each of the edges 19 to maximize stiffness and minimize weight.

At the root end 20 of fan blade 15, on the concave side 21, there is provided a raised portion 22. Surface 23 provides a tapered transition from the concave surface 21 of fan blade 15 to the flat, raised surface 24. The width of the fan blade 15 is reduced adjacent the root end 20 by the surfaces 25 tapering from edges 19 to the juncture of surface 23 with the concave surface of the fan blade. Partially encased within the area of the raised portion 22 is the attachment insert 16.

Attachment insert 16 is a rectangular metal plate, preferably steel, which in one embodiment (FIGS. 1-5) has two flat surfaces 26 and 27, and perimetric edge 28 and an encased portion adjacent three sides of the perimetric edge 28. Insert 16 defines a plurality of elongated slots 29 through the region of the encased portion. The perimeter of the insert 16 is encased within the raised portion 22 during the molding process, with raised portion 22 overlying portions of both surfaces 26 and 27 adjacent the perimetric edge.

During molding, plastic material extends through slots 29, communicating with the overlying plastic material of raised portion 22 on both sides of the insert, thus securely bonding the attachment insert 16 to the fan blade 15. Because raised portion 22 does not overlie all of attachment insert 16, there remain exposed portions 30 and 31, of the insert surfaces 26 and 27, respectively, for attachment with arm 13. The associated arm 13 may be attached to either of the exposed portion 30 or 31. One surface is sometimes preferred, depending upon the clearance requirements of a particular application.

Each of the arms 13 of the spider 11 includes a blade attaching surface for securement to the associated blade assembly 14. The attaching surface of the arm is shaped and sized complementary with the related surface of the blade insert to which the arm is attached. In one embodiment, the complementary surfaces of the arm 13 and of the attachment insert 16 are flat, as shown for example in FIG. 4. The flat configuration is advantageous in that mating surfaces are easily assured. In another embodiment, shown in FIG. 6, the complementary mounting surfaces of the arm and of the attachment insert are curved. Many existing fan spiders include such curved mounting surfaces on the arms, and the present invention is readily employed with this configuration as well.

The provision of exposed surfaces 30 and 31 of the attachment insert 16 permits a ready and secure attachment of the blade assemblies to the fan spider. Also, the attachment does not unduly stress the plastic blade

BEST AVAILABLE COPY material since the attachment is directly between metal and metal, and does not compress or otherwise engage the plastic. In particular, the mating surfaces of the arm and of the attachment insert are shaped and sized complementary with one another to facilitate a firm attachment therebetween. These surfaces may have a variety of shapes, but a relatively smooth surface which may be flat or curved is preferred.

The attachment insert 16 is provided with a plurality of apertures which extend through the plate. In the preferred configuration, there is provided an array of attaching holes, such as 32. The configuration may not be rectangular in some cases. The arm 13 includes a similar array of holes positioned to align with the holes 32 of the attachment insert, and the arm and attachment insert are coupled by rivets, bolts or other fastening members, such as 34, extending through the aligned apertures.

It is desirable that the blade attachment insert 16 be planar in configuration both for adaption into the blade assembly and for mounting to the arm of the fan spider. As used herein and in the claims, the term planar is used to denote a configuration which is relatively thin in comparison to the length and width dimensions of the insert, and which has a pair of opposed, generally parallel surfaces which may or may not be flat. As shown in the drawings, the planar insert is contemplated to include such embodiments as a flat, rectangular insert as in FIGS. 1–5, or a curved insert as in FIG. 6. This planar configuration is advantageous since the insert then may be readily incorporated into a plastic fan blade generally within the area of the blade. Also, the exposed attaching surface preferably has a planar surface, whether flat or curved, to facilitate attachment with the arm and to provide a secure coupling of the insert with the arm.

The fan blade assemblies are constructed to provide a secure attachment of the blade portion to the attachment insert. The insert includes a plurality of apertures 29 into which the plastic of the fan blade extends during the molding operation. Alternatively, grooves, cavities or other irregularities on the surface of the insert or extending through the insert could be used to provide a firm bonding of the fan blade to the insert, without requiring other fastening means. The insert is positioned relative the fan blade to permit attachment with the arm of the fan spider without resulting in contact between the arm and the plastic blade, thus avoiding potential problems due to localized stresses caused by such contact.

The design of the attachment insert is also advantageous in its provision of a low profile for the overall fan blade assembly. As shown in the drawings, the fan blades include a pair of opposed surfaces 24 and 35, and a perimetric edge defined by the blade tip 17, the opposed edges 19 and the root end 20. As shown particularly in FIG. 3, the planar insert 16 is contained fully within the surfaces 24 and 35 of the associated fan blade. Further, the insert surfaces 30 and 31 are generally aligned with the adjacent surfaces 35 and 24, respectively, and are recessed inwardly therefrom. Also, the insert is fully within the perimetric edge of the associated fan blade, with the insert including a part of its perimetric edge aligned with the root end of the fan blade and a second part 36 spaced inwardly of the edge of the fan blade and encased by portions 37 and 38 of the blade which overlie the outer perimetric portions of the insert.

All of these features further enhance the low profile of the blade assembly since the insert does not project outwardly of the blade, and the arm may be attached to the insert also with a low profile. As examplified in FIG. 4, the fan blade assembly may be configured to provide for attachment of the arm 13 on either side of the insert within the recess of the insert relative the blade surface.

Other features may be readily incorporated into the present invention depending on the intended use of the fan apparatus or any needs resulting therefrom. A plurality of holes, such as 39, may be included in the attachment insert 16 for the placement of balancing weights. Aligned holes 40 may then be included in the arm of the fan spider. The placement of various weights in these holes is used to provide overall balance for the fan apparatus.

Figure 6:
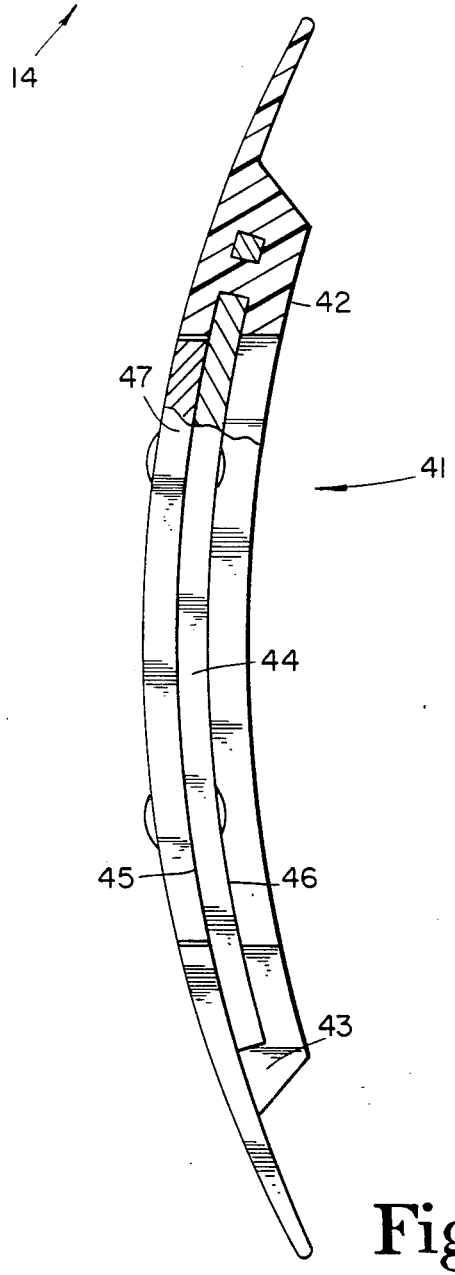
FIG. 6 is an end view, partially in section, of an alternate embodiment for a fan blade assembly useful in conjunction with the present invention.

In FIG. 6 there is shown a related embodiment in which the planar insert and fan blade have an arcuate shape. As shown, the fan blade assembly 41 includes a fan blade similar to that previously described, with the exception that the raised surface 42 is curved in conformance with the general shape of the blade 43. For this embodiment, the insert 44 is similarly curved, although it includes generally parallel opposed surfaces 45 and 46 for attachment with the complementary shaped spider arm 47.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A fan apparatus comprising:

a fan spider having a hub portion and a plurality of arms extending outwardly therefrom, each of the arms including a blade attaching surface;

a plurality of individual fan blade assemblies, each of said assemblies including a blade attachment insert and a fan blade, the fan blade being composed of a plastic material attached to and encasing a portion of the insert, the insert including a first portion encased by the fan blade and a second portion having an externally exposed surface, the insert being secured to the fan blade by the encasement of the first portion of the insert by the fan blade, the exposed surface being for securement with the attaching surface of the arm; and attachment means for attaching each of the fan blade assemblies to a corresponding one of the arms of said fan spider, said attachment means being for securing the exposed surface of a blade attachment insert to the blade attaching surface of the corresponding arm to have the fan blade assembly supported by the connection of the insert and the arm.

2. The apparatus of claim 1 in which the exposed surface of each of the blade attachment inserts is shaped complementary with the blade attaching surface of the corresponding arm.

3. The apparatus of claim 2 in which the exposed surface is planar and in which the blade attaching surface is planar.

4. The apparatus of claim 3 in which each of the blade attachment inserts includes a cavity receiving a portion of the plastic fan blade therein firmly connecting the fan blade with the associated blade attachment insert.

5. The apparatus of claim 3 in which each of the blade attachment inserts includes a passageway communicating through the insert and receiving therein a portion of the plastic fan blade firmly connecting the fan blade with the associated blade attachment insert.

6. The apparatus of claim 1 in which the arms and the corresponding blade attachment inserts are configured to prevent contact between the arms and the plastic fan blades.

7. The apparatus of claim 1 in which each of the plastic fan blades includes a pair of opposed surfaces and a perimetric edge, each of the blade attachment inserts being contained fully within the surfaces of the associated fan blade.

8. The apparatus of claim 1 in which each of the plastic fan blades includes a pair of opposed surfaces and a perimetric edge, the exposed surface of each of the blade attachment inserts being generally aligned with one of the surfaces of the fan blade and being recessed inwardly therefrom.

9. The apparatus of claim 1 in which each of the plastic fan blades includes a pair of opposed surfaces and a perimetric edge, each of the blade attachment inserts being fully contained within the perimetric edge of the associated fan blade.

10. The apparatus of claim 1 in which each of the blade attachment inserts includes a cavity receiving a portion of the plastic fan blade therein firmly connecting the fan blade with the associated blade attachment insert.

11. The apparatus of claim 10 in which each of the blade attachment inserts includes a passageway communicating through the insert and receiving therein a portion of the plastic fan blade firmly connecting the fan blade with the associated blade attachment insert.

12. The apparatus of claim 1 in which each of the blade attachment inserts is flat and in which in which the blade attachment surfaces of the arms and each of the exposed attaching surfaces of the blade attachment inserts is flat.

13. The apparatus of claim 12 in which the arms and the corresponding blade attachment inserts are configured to prevent contact between the arms and the plastic fan blades.

14. The apparatus of claim 12 in which each of the plastic fan blades includes a pair of opposed surfaces and a perimetric edge, each of the blade attachment inserts being contained fully within the surfaces of the associated fan blade.

15. The apparatus of claim 12 in which each of the plastic fan blades includes a pair of opposed surfaces and a perimetric edge, the exposed surface of each of the blade attachment inserts being generally aligned with one of the surfaces of the fan blade and being recessed inwardly therefrom.

16. The apparatus of claim 12 in which the blade attachment insert has a perimetric edge portion, the associated fan blade being positioned over and encasing at least a part of the perimetric edge portion of the insert.

17. The apparatus of claim 16 in which each blade attachment insert has a first flat surface and a second, opposed flat surface, each insert including a passageway communicating between the first and second surfaces of the insert and receiving therein a portion of the plastic fan blade firmly connecting the fan blade with the associated blade attachment insert.

18. The apparatus of claim 17 in which each of the plastic fan blades includes a pair of opposed surfaces and a perimetric edge, each of the blade attachment inserts being contained fully within the surfaces of the associated fan blade.

19. The apparatus of claim 18 in which each of the plastic fan blades includes a pair of opposed surfaces and a perimmetric edge, the exposed surface of each of the blade attachment inserts being generally aligned with one of the surfaces of the fan blades and being recessed inwardly therefrom.

20. The apparatus of claim 12 in which each blade attachment insert has a first flat surface and a second, opposed flat surface, each insert including a passageway communicating between the first and second surfaces of the insert and receiving therein a portion of the plastic fan blade firmly connecting the fan blade with the associated blade attachment insert.

21. The apparatus of claim 12 in which each of the fan blades has a perimetric edge and includes a root end, the blade insert having a perimetric edge having a first part aligned with the perimetric edge of the fan blade at the root end of the fan blade and a second part spaced inwardly of the perimetric edge of the fan blade, the plastic fan blade being positioned over and encasing at least some of the second part of the perimetric edge of the blade insert.

22. The apparatus of claim 21 in which each blade attachment insert has a first flat surface and a second, opposed flat surface, each insert including a passageway communicating between the first and second surfaces of the insert and receiving therein a portion of the plastic fan blade firmly connecting the fan blade with the associated blade attachment insert.

23. The apparatus of claim 21 in which each of the plastic fan blades includes a pair of opposed surfaces and a perimetric edge, each of the blade attachment inserts being fully contained within the perimetric edge of the associated fan blade.

24. The apparatus of claim 23 in which each of the plastic fan blades includes a pair of opposed surfaces and a perimetric edge, each of the blade attachment inserts being contained fully within the surfaces of the associated fan blade.

25. The apparatus of claim 24 in which each of the plastic fan blades includes a pair of opposed surfaces and a perimetric edge, the exposed surface of each of the blade attachment inserts being generally aligned with one of the surfaces of the fan blade and being recessed inwardly therefrom.

26. The apparatus of claim 25 in which each blade attachment insert has a first flat surface and a second, opposed flat surface, each insert including a passageway communicating between the first and second surfaces of the insert and receiving therein a portion of the plastic fan blade firmly connecting the fan blade with the associated blade attachment insert.

* * * * *